US009032994B2

(12) United States Patent
McHugh et al.

(10) Patent No.: US 9,032,994 B2
(45) Date of Patent: May 19, 2015

(54) FIRE SUPPRESSION CIRCULATION SYSTEM

(75) Inventors: George J. McHugh, Berwyn, PA (US); George McHugh, IV, legal representative, Malvern, PA (US); James P. McHugh, Berwyn, PA (US)

(73) Assignee: AGF MANUFACTURING, INC., Malvern, PA (US)

( * ) Notice: Subject to any disclaimer, the term of this patent is extended or adjusted under 35 U.S.C. 154(b) by 392 days.

(21) Appl. No.: 13/453,524

(22) Filed: Apr. 23, 2012

(65) Prior Publication Data

US 2012/0204963 A1 Aug. 16, 2012

Related U.S. Application Data

(63) Continuation of application No. 12/010,636, filed on Jan. 28, 2008, now abandoned.

(51) Int. Cl.

| | |
|---|---|
| ***A62C 35/68*** | (2006.01) |
| ***A62C 35/62*** | (2006.01) |
| ***A62C 37/50*** | (2006.01) |

(52) U.S. Cl.

CPC ..... *A62C 37/50* (2013.01); *A62C 35/68* (2013.01)

(58) Field of Classification Search

CPC ..... A62C 35/68; E03B 7/12
USPC ..... 137/563; 169/16, 17, 18
See application file for complete search history.

(56) References Cited

U.S. PATENT DOCUMENTS

| | | | |
|---|---|---|---|
| 4,366,865 | A | 1/1983 | Makibbin |
| 4,741,361 | A | 5/1988 | McHugh |
| 4,852,610 | A | 8/1989 | McHugh |
| 4,971,109 | A | 11/1990 | McHugh |
| 4,995,423 | A | 2/1991 | McHugh |
| 5,103,862 | A | 4/1992 | McHugh |
| 6,302,146 | B1 | 10/2001 | McHugh |
| 2006/0151184 | A1 | 7/2006 | Boyle |
| 2009/0038809 | A1 | 2/2009 | Sundholm |

FOREIGN PATENT DOCUMENTS

| | | | |
|---|---|---|---|
| GB | 2280369 | A | 2/1995 |
| JP | 63-084569 | A | 4/1988 |
| JP | 09-215766 | A | 8/1997 |
| WO | WO 97/49923 | | 12/1997 |
| WO | WO 02/07825 | A1 | 1/2002 |
| WO | WO 2009/097112 | | 8/2009 |

*Primary Examiner* — Atif Chaudry

(74) *Attorney, Agent, or Firm* — Buchanan Ingersoll & Rooney PC

(57) ABSTRACT

An arrangement for testing a fire suppression sprinkler system includes a supply conduit for supplying a fire suppression fluid to a plurality of sprinklers. A sensor senses a flow of fire suppression fluid through the supply conduit. A drain conduit drains fire suppression fluid when the fire suppression system is tested. A drain valve controls the flow of the fire suppression fluid so that when the fire suppression system is tested the fire suppression fluid is controlled to enter the drain conduit. A fire suppression fluid collection tank collects the fire suppression fluid which has entered the drain conduit for reintroducing the collected fire suppression fluid to the supply conduit. A circulation valve controls the flow of the fire suppression fluid so that when the fire suppression system is tested the fire suppression fluid enters the fire suppression fluid collection tank.

15 Claims, 2 Drawing Sheets

FIRE SUPPRESSION CIRCULATION SYSTEM

CROSS-REFERENCE TO RELATED PATENT APPLICATION

This application is a continuation of U.S. application Ser. No. 12/010,636, filed Jan. 28, 2008, the entire contents of which is hereby incorporated by references.

BACKGROUND AND SUMMARY

The present invention relates generally to testing fire suppression fluid sprinkler systems, and in particular the testing of flow switches in fire suppression fluid sprinkler systems.

In a typical fire suppression water sprinkler system as installed in many buildings, an array of individual fire sprinklers is supplied with water through a main conduit and various branch conduits. The individual fire sprinklers are generally provided with a member that melts when the ambient temperature reaches a predetermined level indicative of a fire. The melting of the member opens a fire sprinkler to spray water in order to suppress the fire. The individual fire sprinklers are provided with meltable members so that the spray of water will hopefully be limited to the region of the building where the fire is present. In this way, the extent of water damage may be minimized.

Such fire suppression systems also oftentimes have a switch or sensor that detects the flow of water in the conduits to indicate that even only one of the individual water sprinklers has opened. Since the flow of water in the conduits generally means that a fire is present in the building, the switch or sensor typically triggers a fire alarm or sends an appropriate signal directly to a fire department. Therefore, many codes require, and it is generally otherwise desirable, that the switch or sensor which detects the flow of water in the conduits be periodically tested. Accordingly, it has also become conventional in the art to provide a valve which enables the system to be tested by permitting a flow of water corresponding to the flow through only one individual water sprinkler that has been opened.

Various testing valves and arrangements for testing and also for draining fire suppression systems are known in the art such as are shown and described in U.S. Pat. Nos. 6,302,146, 5,103,862, 4,971,109, 4,995,423, 4,852,610, 4,741,361 all of AGF Manufacturing, Inc. These patents are each incorporated herein by reference.

The main water conduit typically has a plurality of branch conduits including a number of sprinkler heads. Typically, a supply valve either for the entire fire suppression system or for a particular floor or for a portion of the system, is provided in the main water conduit. Downstream of the supply valve is the fire suppression fluid flow sensor which is configured to detect a flow through the conduit corresponding at least to the flow through a single sprinkler head. A testing valve may be provided to provide a flow of fire suppression fluid corresponding to the flow through a sprinkler head.

The water flows through the valves and various arrangement for testing fire suppression systems and is then directed to a drain and into the local waste water system. Although an individual test of a fire suppression fluid flow sensor may require 10 to 12 gallons, in a large multi-story building the testing procedure results in the use of a large quantity of water that is ultimately released into the waste water system.

The construction industry has increasingly recognized the environmental, economic and health and community benefits of providing so-called green buildings. The establishment of the leadership in energy and environmental design (LEED) Green Building Rating System™ recognizes that reducing water consumption provides environmental, economic and health and community benefits. These benefits include conserving natural resources, reducing operating costs, enhancing asset value and profits and minimizing the strain on local infrastructure.

In view of the above background information, it is an object of the preferred embodiments of the present invention to provide a circulation system by which a fire suppression system may be tested, and fire suppression fluid used during testing is circulated to be reused.

It is another object of the preferred embodiments of the present invention to provide a circulation valve and tank arrangement whereby fluid used when a fire suppression system is tested is not discarded as waste.

It is another object of the preferred embodiments of the present invention to provide a fluid tank to hold fluid used when a fire suppression system is tested for eventual reintroduction into the fluid supply.

It is another object of the preferred embodiments of the present invention to provide methods whereby fluid used when a fire suppression system is tested is not discarded as waste.

The above objects as well as other objects not specifically mentioned are accomplished by a valve arrangement for testing a fire suppression sprinkler system, in accordance with the present invention, in which a conduit supplies a fire suppression fluid to a plurality of sprinklers. In the arrangement, a circulation valve is provided downstream of a valve arrangement for testing a fire suppression sprinkler system to direct fire suppression fluid used during testing to a fluid holding tank and then to a circulation conduit to be reintroduced to the fluid supply whereby said fire suppression sprinkler system may be tested without waste of fire suppression fluid.

BRIEF DESCRIPTION OF THE DRAWING FIGURES

The preferred embodiments of the present invention will be described in greater detail with reference to the accompanying drawings, wherein like members bear like reference numerals and wherein.

DETAILED DESCRIPTION OF THE PREFERRED EMBODIMENTS

Figure 1:
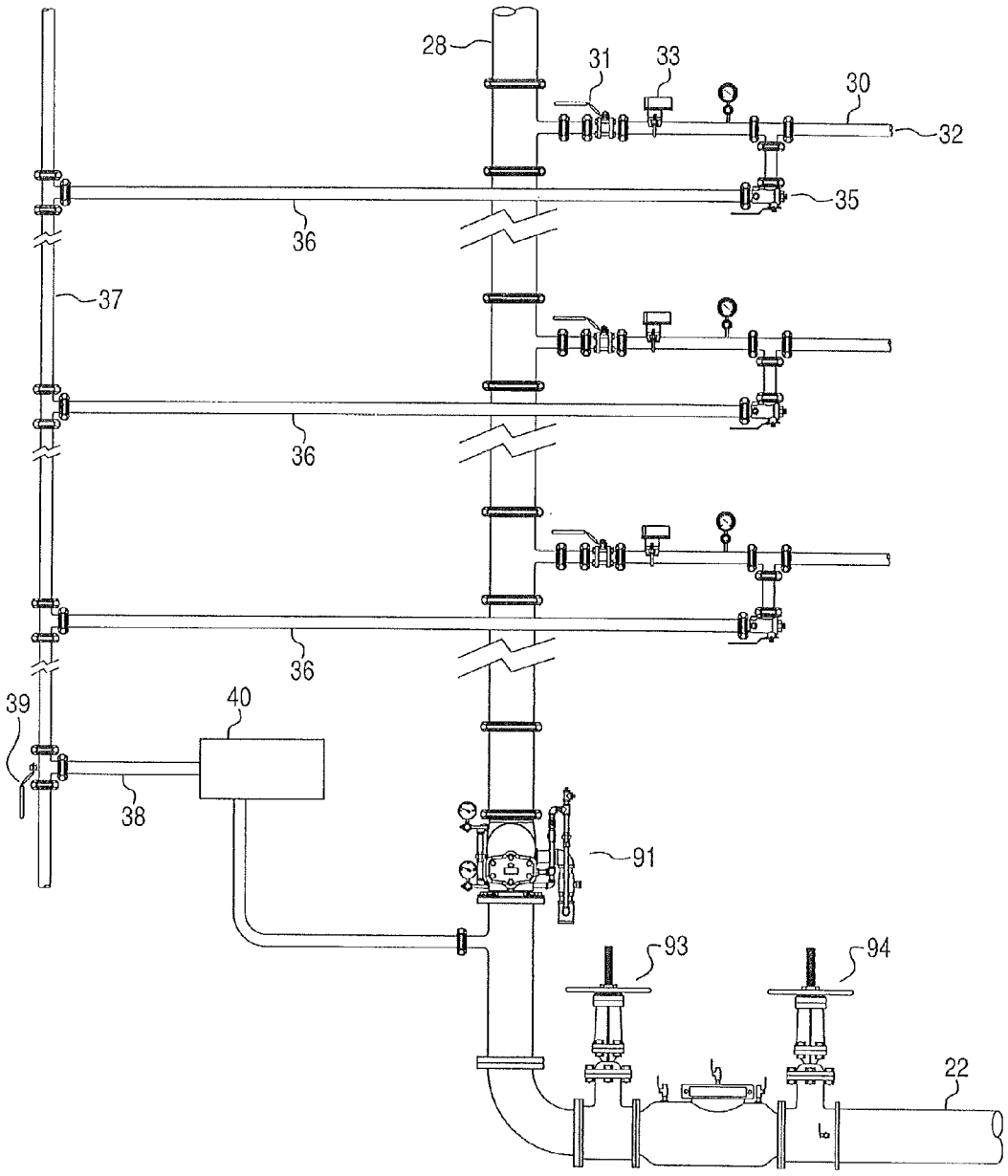
FIG. 1 is a side view of a valve arrangement according to the present invention.

With reference to FIG. 1, a supply riser 28 receives a supply of fire suppression fluid, such as water, from an incoming supply 22 which is typically connected to a municipal water supply. The supply riser 28 has a plurality of branch conduits 30 including a number of sprinkler heads 32. Typically, a supply valve 31 either for an entire fire suppression system or for a particular floor or for a portion of the system is provided from the supply riser 28. The fluid is provided in the supply riser 28 at a pressure high enough to properly supply and operate the system. In some systems the municipal water pressure may be sufficient. Typically, in multi-story hi-rise buildings there will be a pressure loss of 5 psi per story. Therefore it may be necessary to provide a pump to bring and maintain the water to a sufficient operating pressure.

During testing of the typical fire suppression system, the fire suppression fluid is permitted to flow at least through the portion of the branch conduit 30 that includes a sensor or flow switch 33 utilizing a test and drain valve 35. The sensor 33 detects the flow through the conduits and either sends an alarm or triggers a mechanical alarm that indicates the fluid flow. Fluid that has passed through the branch conduit 30 during the testing is directed to the drain riser 37 via a drain branch conduit 36 by the test and drain valve 35 provided between the branch conduit 30 and the drain branch conduit 36. The test and drain valve 35 may be operated either locally or remotely to provide fluid communication between the branch conduit 30 and the drain conduit 36 during testing of the fire suppression system. In a non-test mode fluid communication between the branch conduit 30 and the drain conduit 36 may be blocked. In a conventional system the fluid used to test the fire suppression system is drained as waste.

According to a preferred embodiment of the invention, the fluid that has passed through the system during testing and then to the drain riser 37 via a branch conduit 36 may be diverted by a circulation valve 39 into a fluid tank 43 where it may be circulated back into the supply riser 28 to be reused as necessary. The fluid tank 43 may have a size of 50 gallons. However, it should be appreciated that the fluid tank 43 may be any suitable size depending on the system requirements. The fluid tank 43 may include a sensor 90 that detects a fluid level and/or pressure inside the fluid tank 43.

Circulation valve 39 is placed to divert fluid either to drain as waste water or to the fluid tank 43. Circulation valve 39 may be operated to divert fluid to the fluid tank when the system is in the test mode. The circulation valve 39 may be operated remotely. In the event that the fluid tank 43 is determined to be full by the sensor 90 because of a malfunction or for some other reason, the circulation valve 39 may be operated to divert fluid to the drain. The circulation valve 39 may include an alarm switch 91 that indicates to a user that the circulation valve 39 is positioned to circulate the fluid.

Figure 2:
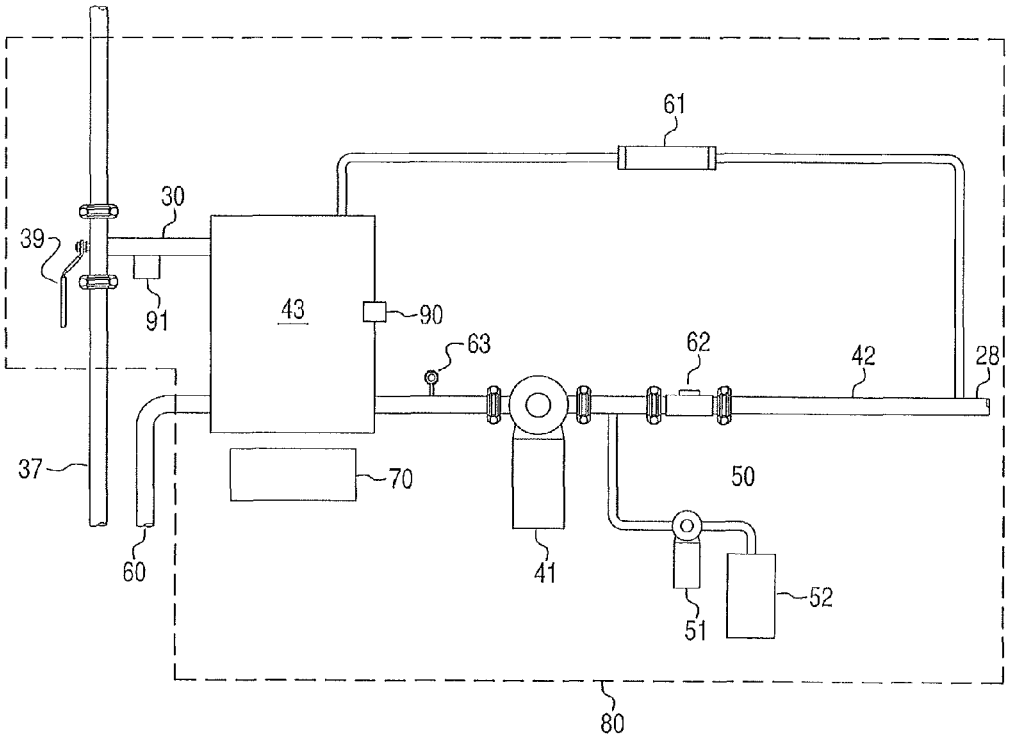
FIG. 2 is a schematic of a circulation system according to the present invention.

As shown in FIG. 2, fluid collected in the fluid tank 43 is reintroduced via a high pressure pump 41 through a circulation conduit 42 if the system utilizes fluid at a pressure supplied from the incoming supply 22, for example, the pressure of the municipal water supply. If the system requires a pump to provide and/or maintain the fire suppression fluid pressure, the fluid from the fluid tank 43 may be provided through a circulation conduit 42 to the pump inlet, whereby the pump brings the circulated fluid up to the required system pressure. The high pressure pump 41 may include a high pressure limit switch to maintain the fluid pressure within a designated range. Typically, a sprinkler head will have an orifice from ½"-¾". In many applications the high pressure pump 41 may have an orifice size of 1" because during testing the fluid that flows through the circulation system corresponds to the flow through a single sprinkler head.

Because the water provided through the water tank is circulated there may be an increased risk of microbiologically induced corrosion or MIC. MIC can lead to shorter system life by corrosion from microbial action that may result in fatigue and failure of particular conduits. In preferred embodiments of the invention, a metering pump system 50 includes a metering pump 51 which introduces measured amounts of chemicals formulated to neutralize MIC is the conduits. The chemicals are held in a chemical storage tank 52.

The fluid tank 43, the high pressure pump 41, the control components 70, the metering pump system 50 and the circulation valve 39 may be provided in a cabinet 80 suitably located, for example, in a mechanical equipment room. The control system 70 may include any suitable control system, for example, an electrical, an electronic or a pneumatic system capable of operating the components of the preferred embodiments of the invention.

A method of operation according to a preferred embodiment of the invention will now be described. One of gate valves 93,94 is closed to block the fluid from the incoming supply 22. The test and drain valve 35 is placed in a test mode which allows fluid communication between the branch conduit 30 and the drain conduit 36. The circulation valve 39 is positioned so that fluid is directed into the fluid tank 43. The fluid directed into the fluid tank 43 is circulated back into the supply riser 28 by the high pressure pump 41 or the system pump, where it is reused. It should be appreciated that the system and its constituent apparatus may be operated remotely.

A priming line 60 may be provided in fluidic connection with the fluid tank 43 for priming the flow of fluid into the fluid tank 43. A bleeder valve arrangement 61 may be provided between the fluid tank 43 and the circulation conduit 42 to adjust the fluid pressure there between. An air eliminator 63 may be provided to bleed off excess air in the system. A pressure control, pressure regulating, or check valve 62 may be provided in the circulation conduit 42 to prevent flow from reversing. An alarm valve or a "shotgun valve" may be provided in the main fire suppression fluid conduit 28.

The principles, preferred embodiments and mode of operation of the present invention have been described in the foregoing specification. However, the invention which is intended to be protected is not to be construed as limited to the particular embodiments disclosed. The embodiments are therefore to be regarded as illustrative rather than as restrictive. Variations and changes may be made without departing from the spirit of the present invention. Accordingly, it is expressly intended that all such equivalents, variations and changes which fall within the spirit and scope of the present invention as defined in the claims be embraced thereby.

What is claimed is:

1. An arrangement for testing a fire suppression sprinkler system, comprising:

a drain conduit;

a supply conduit for supplying a fire suppression fluid to a plurality of branch conduits, each branch conduit having a sensor provided upstream of a plurality of sprinklers, said sensor sensing a flow of said fire suppression fluid in said branch conduit, and a test and drain valve, said test and drain valve selectively permitting a flow of said fire suppression fluid through said branch conduit corresponding to the flow of fire suppression fluid through only one sprinkler, said test and drain valve being provided downstream of said sensor, said test and drain valve also selectively providing communication of said fire suppression fluid from said branch conduit to said drain conduit;

a fire suppression fluid collection tank;

a circulation valve, said circulation valve having an inlet in fluid communication with said drain conduit, a first outlet in direct fluid communication with said fire suppression fluid collection tank, and a second outlet in fluid communication with said drain conduit, whereby fire suppression fluid may be selectively diverted from the drain conduit to the fire suppression fluid collection tank;

circulation piping having an inlet in fluid communication with said fire suppression fluid collection tank and an outlet in fluid communication with said supply conduit whereby said fire suppression fluid that has been used in testing said fire suppression sprinkler system may be directly introduced from said fire suppression fluid collection tank into said supply conduit; and a pump for increasing pressure of the fire suppression fluid that has been used in testing said fire suppression sprinkler system substantially to pressure of the fire suppression fluid in the supply conduit, said pump being downstream of said circulation valve.

2. The arrangement of claim 1 wherein the fire suppression fluid is water.

3. The arrangement of claim 1 wherein the test and drain valve is remotely controlled.

4. The arrangement of claim 1, further comprising:

a pump for injecting measured amounts of chemicals into the fire suppression fluid to neutralize microbiologically induced corrosion.

5. The arrangement of claim 4 wherein the collection tank, the pump for increasing the pressure of the fire suppression fluid that has been used in testing said fire suppression sprinkler system, and the pump for injecting measured amounts of chemicals into the fire suppression fluid are provided in a cabinet.

6. The arrangement of claim 1 wherein the circulation valve is remotely controlled.

7. The arrangement of claim 1 wherein the collection tank and the pump for increasing the pressure of the fire suppression fluid that has been used in testing said fire suppression sprinkler system are provided in a cabinet.

8. The arrangement of claim 1 wherein the first outlet of each test and drain valve is directly connected to the fluid collection tank through the drain conduit and the circulation valve to form an essentially closed passageway whereby the fluid collection tank only receives fire suppression fluid that has been used to test the fire suppression system.

9. An arrangement for testing a fire suppression sprinkler system, comprising:

a drain conduit;

a supply conduit for supplying a fire suppression fluid to a plurality of branch conduits, each branch conduit having a sensor provided upstream of a plurality of sprinklers, said sensor sensing a flow of said fire suppression fluid in said branch conduit, and a test and drain valve, said test and drain valve selectively permitting a flow of said fire suppression fluid through said branch conduit corresponding to the flow of fire suppression fluid through only one sprinkler, said test and drain valve being provided downstream of said sensor, said test and drain valve also selectively providing communication of said fire suppression fluid from said branch conduit to said drain conduit;

a fire suppression fluid collection tank, said fire suppression fluid collection tank receiving fire suppression fluid from the drain conduit;

circulation piping having an inlet in fluid communication with said fire suppression fluid collection tank and an outlet in fluid communication with said supply conduit whereby said fire suppression fluid that has been used in testing said fire suppression sprinkler system may be directly introduced from said fire suppression fluid collection tank into said supply conduit; and a pump for increasing pressure of the fire suppression fluid that has been used in testing said fire suppression sprinkler system substantially to pressure of the fire suppression fluid in the supply conduit;

wherein the outlet of each test and drain valve is connected to the fluid collection tank through the drain conduit thereby forming an essentially closed passageway whereby the fluid collection tank only receives fire suppression fluid that has been used to test the fire suppression system.

10. The arrangement of claim 9 wherein the fire suppression fluid is water.

11. The arrangement of claim 9 wherein the test and drain valve is remotely controlled.

12. The arrangement of claim 9, further comprising:

a pump for injecting measured amounts of chemicals into the fire suppression fluid to neutralize microbiologically induced corrosion.

13. The arrangement of claim 12 wherein the collection tank, the pump for increasing the pressure of the fire suppression fluid that has been used in testing said fire suppression sprinkler system, and the pump for injecting measured amounts of chemicals into the fire suppression fluid are provided in a cabinet.

14. The arrangement of claim 9 wherein the collection tank and the pump for increasing the pressure of the fire suppression fluid that has been used in testing said fire suppression sprinkler system are provided in a cabinet.

15. A method for circulating water used during testing of a fire suppression system, the method comprising:

testing a first branch of the fire suppression system by opening a test and drain valve provided in the first branch to permit water to flow through the test and drain valve provided in the first branch corresponding to the flow through a single sprinkler head of the first branch of the fire suppression system;

sensing the flow through the test and drain valve of the first branch;

directing the water that has flowed through the test and drain valve of the first branch during the testing to a drain conduit and then to a tank;

supplying the water from the tank to a pump;

increasing pressure of the water from the tank to a predetermined level;

supplying the water from the pump to the fire suppression system;

subsequently testing a second branch of the fire suppression system by opening a test and drain valve provided in the second branch to permit water to flow through the test and drain valve of the second branch corresponding to the flow through a single sprinkler head of the second branch of the fire suppression system;

sensing the flow through the test and drain valve of the second branch;

directing the water that has flowed through the test and drain valve of the second branch during the testing to the drain conduit and then to the tank;

supplying the water from the tank to the pump, the water from the tank being only water used to test the fire suppression system;

increasing the pressure of the water from the tank to the predetermined level; and supplying the water from the pump to the fire suppression system.

* * * * *